US012060815B2

(12) United States Patent
Malischewski et al.

(10) Patent No.: US 12,060,815 B2
(45) Date of Patent: Aug. 13, 2024

(54) VARIABLE VALVE TRAIN FOR AN ENGINE BRAKING MODE

(71) Applicant: MAN Truck & Bus SE, Munich (DE)

(72) Inventors: Thomas Malischewski, Munich (DE); Steffen Hirschmann, Munich (DE); Andreas Bug, Munich (DE)

(73) Assignee: MAN Truck & Bus SE, Munich (DE)

( * ) Notice: Subject to any disclaimer, the term of this patent is extended or adjusted under 35 U.S.C. 154(b) by 0 days.

(21) Appl. No.: 17/629,320

(22) PCT Filed: Jul. 17, 2020

(86) PCT No.: PCT/EP2020/070265

§ 371 (c)(1),
(2) Date: Jan. 21, 2022

(87) PCT Pub. No.: WO2021/013718

PCT Pub. Date: Jan. 28, 2021

(65) Prior Publication Data

US 2022/0251978 A1 Aug. 11, 2022

(30) Foreign Application Priority Data

Jul. 23, 2019 (DE) ..... 102019119870.4

(51) Int. Cl.
*F01L 13/06* (2006.01)
*F01L 1/18* (2006.01)
(Continued)

(52) U.S. Cl.
CPC ..... *F01L 13/06* (2013.01); *F01L 1/181* (2013.01); *F01L 1/267* (2013.01); *F01L 1/46* (2013.01);
(Continued)

(58) Field of Classification Search
CPC ..... F01L 1/053; F01L 1/181; F01L 2001/186; F01L 2001/2444; F01L 1/267; F01L 1/46;
(Continued)

(56) References Cited

U.S. PATENT DOCUMENTS

2004/0231639 A1 11/2004 Israel et al.
2010/0071643 A1 3/2010 Smith et al.
(Continued)

FOREIGN PATENT DOCUMENTS

CN 105612317 A 5/2016
CN 107842408 A 3/2018
(Continued)

OTHER PUBLICATIONS

German Search Report issued in German Patent Application No. 102019119870.4 dated Mar. 17, 2020, 10 pages. No English translation is available.
(Continued)

*Primary Examiner* — Jorge L Leon, Jr.
(74) *Attorney, Agent, or Firm* — Weber Rosselli & Cannon LLP

(57) ABSTRACT

The invention relates to a variable valve train for switching an outlet valve of an internal combustion engine to an engine braking mode. The variable valve train has a camshaft with a first cam, which is designed as a normal operation cam, and a second cam, which is designed as an engine braking cam. A first rocking lever has a first stroke device which is designed for selectively making or breaking a first operative connection between the first cam and the outlet valve by means of the first rocking lever. A second rocking lever has a second stroke device which is designed for selectively making or breaking a second operative connection between the second cam and the outlet valve by means of the second
(Continued)

rocking lever. A valve device selectively connects the first stroke device or the second stroke device to a fluid feed line.

21 Claims, 4 Drawing Sheets

(51) Int. Cl.
*F01L 1/26* (2006.01)
*F01L 1/46* (2006.01)
*F01L 1/053* (2006.01)
*F01L 1/24* (2006.01)

(52) U.S. Cl.
CPC ..... *F01L 1/053* (2013.01); *F01L 2001/186* (2013.01); *F01L 2001/2444* (2013.01); *F01L 13/065* (2013.01); *F01L 2305/02* (2020.05); *F01L 2820/031* (2013.01)

(58) Field of Classification Search
CPC ..... F01L 13/06; F01L 13/065; F01L 2305/02; F01L 2820/031
USPC ..... 123/90.39, 90.4, 90.44, 90.46
See application file for complete search history.

(56) References Cited

U.S. PATENT DOCUMENTS

| | | | | |
|---|---|---|---|---|
| 2013/0269652 | A1* | 10/2013 | Toth | F01L 1/18 123/323 |
| 2019/0055858 | A1* | 2/2019 | Bogdanski | F01L 1/2416 |
| 2019/0242278 | A1* | 8/2019 | Zurk | F01L 13/06 |
| 2019/0360362 | A1* | 11/2019 | Cecil | F01L 13/06 |
| 2021/0277807 | A1* | 9/2021 | Cecur | F01L 13/06 |

FOREIGN PATENT DOCUMENTS

| | | | | |
|---|---|---|---|---|
| CN | 109209541 | A | 1/2019 | |
| DE | 3543537 | A * | 4/1986 | F01L 1/08 |
| DE | 3543537 | A1 | 4/1986 | |
| DE | 4025569 | C1 | 7/1991 | |
| DE | 112009000111 | | 12/2010 | |
| DE | 102013215946 | A1 | 2/2015 | |
| DE | 102017118852 | A1 | 2/2019 | |
| EP | 1462623 | A1 | 9/2004 | |
| EP | 3444451 | A1 | 2/2019 | |
| JP | H04109010 | A | 4/1992 | |
| WO | 2018185197 | A1 | 10/2018 | |

OTHER PUBLICATIONS

International Search Report, with English translation and Written Opinion issued PCT Application No. PCT/EP2020/070265 dated Oct. 14, 2020, 22 pages.
The First Office Action issued in Chinese Patent Application No. 202080050455.8 dated Apr. 1, 2024 with English translation.
Brazilian Office Action issued in Brazilian Patent Application No. BR112022000636-5 dated Apr. 15, 2024 with English translation.

* cited by examiner

VARIABLE VALVE TRAIN FOR AN ENGINE BRAKING MODE

CROSS-REFERENCE TO RELATED APPLICATIONS

This application is a 371 application of PCT/EP2020/070265 filed Jul. 17, 2020, which claims benefit of and priority to German Patent Application Serial No. DE102019119870.4 filed Jul. 23, 2019, the disclosures of the above-identified applications are hereby incorporated by reference in their entirety.

The present disclosure relates to a variable valve train for switching an outlet valve of an internal combustion engine to an engine braking mode.

It is known to use variable valve trains to change switching times and valve strokes of gas exchange valves of an internal combustion engine during the operation of the internal combustion engine. A plurality of variable valve trains are known in the prior art.

Variable valve trains may be used, for example, to operate outlet valves of the cylinders of an internal combustion engine in an engine braking mode, in which a valve control curve of the outlet valves deviates from normal operation.

DE 40 25 569 C1 discloses a valve control of an internal combustion engine which is able to be switched as a drive or a brake, with outlet valves which are controlled differently by a camshaft via control rocking levers in drive function and braking function, a further auxiliary cam (brake cam) acting thereon in braking function, in addition to the cams acting in drive function. In each case a brake rocking lever guided by a brake cam and bearing in a resilient manner thereon is mounted coaxially to a control rocking lever of an outlet valve, said brake rocking lever being able to be blocked on the control rocking lever during braking operation.

DE 10 2017 118 852 A1 discloses a force transmission device for a variable valve train of an internal combustion engine. The force transmission device has a first rocking lever device. The first rocking lever device has a first cam follower and a first receiver for the first cam follower. The first cam follower is displaceable and blockable in the first receiver. The force transmission device has a second rocking lever device. The second rocking lever device has a second cam follower and a second receiver for the second cam follower. The second cam follower is displaceable and blockable in the second receiver.

The object of the present disclosure is to provide an alternative and/or improved variable valve train for an engine braking mode.

The object is achieved by the features of the independent claim 1. Advantageous developments are specified in the dependent claims and the description.

The present disclosure provides a variable valve train for switching a (cylinder) outlet valve of an internal combustion engine to an engine braking mode. The variable valve train has a camshaft with a first cam which is designed as a normal operation cam and a second cam which is designed as an engine braking cam. The variable valve train has a first rocking lever with a first stroke device which is designed for optionally (selectively) making or breaking a first operative connection between the first cam and the outlet valve by means of the first rocking lever. The variable valve train has a second rocking lever with a second stroke device which is designed for optionally (selectively) making or breaking a second operative connection between the second cam and the outlet valve by means of the second rocking lever. The variable valve train has a (for example hydraulic) fluid feed line and a valve device which is designed optionally (selectively) to connect (for example only) the first stroke device or (for example only) the second stroke device to the fluid feed line.

The variable valve train may provide an engine braking system in a structurally simple and at the same time reliable manner by a combination of two stroke devices which activate (or deactivate) a cam contour of a normal operation cam and an engine braking cam, with an upstream valve device, either the first stroke device or the second stroke device being able to be activated thereby. The engine braking function may thus be expediently performed by means of a two-fold hydraulic actuating system. The switching functionality of the valve device (switching between the stroke devices) may be implemented in a simple manner. A variable valve train constructed in such a manner may additionally permit the simple implementation of further features, for example a hydraulic valve clearance compensating device.

Expediently, the rocking levers may be rigidly arranged on one another or pivotable relative to one another.

It is possible that the rocking levers form a common lever body.

In one exemplary embodiment, the variable valve train also has a (for example hydraulic) fluid drain line. The valve device is designed to connect selectively (for example only) the first stroke device or (for example only) the second stroke device to the fluid drain line. Preferably, the valve device is designed in a (first) position to connect the first stroke device to the fluid feed line and to connect the second stroke device to the fluid drain line. Alternatively or additionally, the valve device is also designed in a (second) position to connect the first stroke device to the fluid drain line and to connect the second stroke device to the fluid feed line. Thus the respectively desired stroke device may be activated in a very simple manner by the choice of position of the valve device.

Expediently, a control and/or regulating unit of the internal combustion engine may bring about an adjustment of the valve device. The valve device may be actuatable, for example, electrically, pneumatically, hydraulically, by motor and/or magnetically.

In a further exemplary embodiment, the variable valve train has a first backflow preventer which is preferably arranged in a fluidic connection between the valve device and the first stroke device. Alternatively or additionally, the variable valve train has a second backflow preventer which is preferably arranged in a fluidic connection between the valve device and the second stroke device.

Expediently, the first and/or second backflow preventer may be received in the respective rocking lever or arranged outside the respective rocking lever.

Preferably the first and/or second backflow preventer may be provided separately from the valve device.

In a further exemplary embodiment, the first backflow preventer is designed to act as a hydraulic valve clearance compensating device for the first operative connection, preferably in a position of the first backflow preventer in which a backflow from the first stroke device is blocked. Alternatively or additionally, the second backflow preventer is designed to act as a hydraulic valve clearance compensating device for the second operative connection, preferably in a position of the second backflow preventer in which a backflow from the second stroke device is blocked. If, for example, the first and the second stroke device in the respectively activated position is only blocked hydraulically (for example without mechanical blocking elements) the hydraulic valve clearance compensating device may be based on the functionality of the backflow preventer itself. Thus a practical applicability of the variable valve train may be significantly increased.

In one embodiment, the first backflow preventer is designed in a first position to permit a backflow of fluid from the first stroke device to the valve device and/or the fluid drain line (for example for deactivating the first stroke device for compensating for the cam contour of the first cam/for breaking the first operative connection). In a second position, a supply of fluid may be permitted from the valve device to the first stroke device (for example for activating the first stroke device for making the first operative connection). In a third position, a backflow of fluid may be blocked from the first stroke device to the valve device (for example for maintaining the activation of the first stroke device in order to maintain the first operative connection).

In a further embodiment, the second backflow preventer is designed in a first position to permit a backflow of fluid from the second stroke device to the valve device and/or the fluid drain line (for example for deactivating the second stroke device for compensating for the cam contour of the second cam/for breaking the second operative connection). In a second position, a supply of fluid may be permitted from the valve device to the second stroke device (for example for activating the second stroke device for making the second operative connection). In a third position, a backflow of fluid may be blocked from the second stroke device to the valve device (for example for maintaining the activation of the second stroke device in order to maintain the second operative connection).

In a further embodiment, the first position, the second position and/or the third position of the first backflow preventer and/or the second backflow preventer are automatically adjusted as a function of a fluid supply pressure and a fluid counterpressure on the first backflow preventer and/or on the second backflow preventer.

In a variant, with the application of fluid the first stroke device makes the first operative connection and/or with the application of fluid the second stroke device makes the second operative connection.

In an alternative variant, with the application of fluid the first stroke device breaks the first operative connection and/or with the application of fluid the second stroke device breaks the second operative connection.

In an exemplary embodiment, the first stroke device and the second stroke device have the same construction and/or the same function. Thus, for example, the same parts may be used, production costs reduced and incorrect assembly prevented.

It is also possible that the first rocking lever and the second rocking lever have the same construction.

In a further exemplary embodiment, the first stroke device and/or the second stroke device may be blocked only hydraulically and/or is free of a mechanical blocking device. Thus the assigned backflow preventer may act as a hydraulic valve clearance compensating device. The construction of the stroke device is simplified.

In one embodiment, the first stroke device and/or the second stroke device has a receiving chamber, a piston which is displaceably arranged in the receiving chamber, a cam follower which is connected to the piston for displacement, a fluid chamber which is defined by the piston and/or a resilient element which is arranged for pretensioning the piston. Preferably, the fluid chamber may be formed in the receiving chamber. For example, the resilient element may be received in the receiving chamber.

It is possible that the variable valve train is constructed such that the first stroke device and the second stroke device are (for example always) fluidically separated. For example, a fluid line which feeds into the fluid chamber of the first stroke device may be fluidically separated from a fluid line which feeds into the fluid chamber of the second stroke device.

In a further embodiment, the valve device is designed as a directional valve, preferably as a 4-2-way valve or a 4-3-way valve.

In a further embodiment, the valve device is preferably designed to keep the outlet valve closed (for example in a cylinder deactivation mode (for example also with closed inlet valve(s) and without the supply of fuel)) and is also designed in a (third) position to connect the first stroke device and the second stroke device to a fluid drain line. Thus both the first operative connection and the second operative connection may be broken. The outlet valve remains closed during the entire cycle.

In a variant, the first operative connection and the second operative connection act on the outlet valve and a further outlet valve. Alternatively, the first operative connection may act on the outlet valve and a further outlet valve, and the second operative connection may act only on the outlet valve. Thus, for example, only one of two outlet valves of a cylinder may be operated in engine braking mode and the other outlet valve kept closed.

In a further variant, the second cam is designed to keep the outlet valve initially closed in the compression stroke and/or in the exhaust stroke, and to open said outlet valve before reaching a top dead center point of a piston movement, preferably between 100° KW and 60° KW before reaching the top dead center point. The outlet valve, for example, may be kept open in the expansion stroke, closed at the end of the expansion stroke and/or closed at the end of the exhaust stroke.

In a further variant, the first cam is designed such that the outlet valve is opened in the exhaust stroke and is substantially closed in the intake stroke, in the compression stroke and in the expansion stroke.

The present disclosure further relates to a motor vehicle, preferably a utility vehicle (for example a truck or bus) with a variable valve train as disclosed herein.

It is also possible to use the device as disclosed herein for passenger motor vehicles, large engines, all-terrain vehicles, marine engines, etc.

The preferred embodiments and features of the present disclosure described above are able to be combined together in any manner. Further details and advantages of the present disclosure are described hereinafter with reference to the accompanying drawings, in which.

The embodiments shown in the figures at least partially coincide such that similar or identical parts are provided with the same reference numerals and for the description thereof reference is also made to the description of the other embodiments or figures, in order to avoid repetition.

Figure 1:
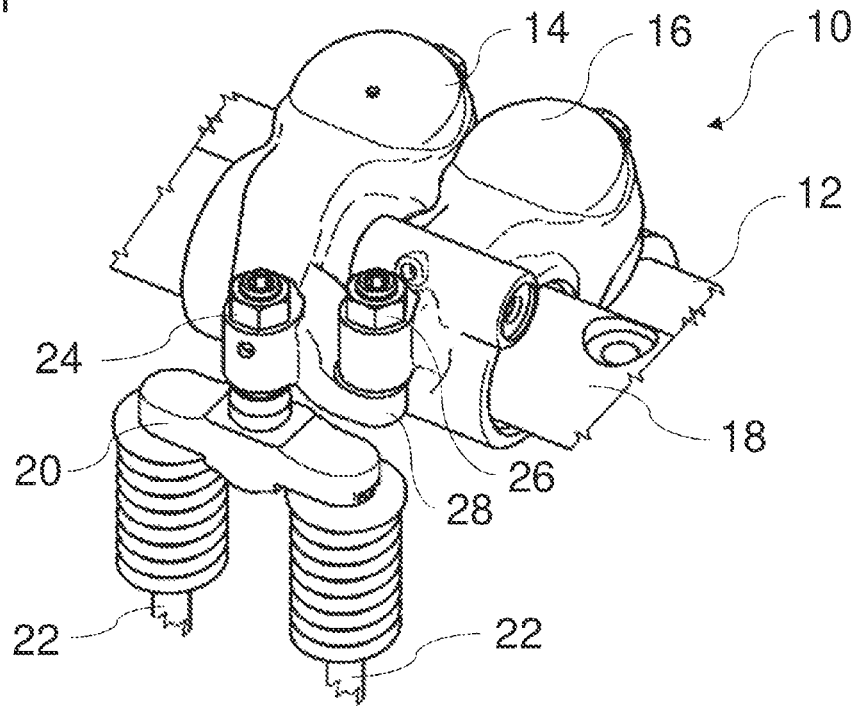
FIG. 1 shows a perspective view of a variable valve train according to an exemplary embodiment of the present disclosure.

In FIG. 1 a variable valve train 10 is shown. The variable valve train 10 may be part of a (reciprocating piston) internal combustion engine. The internal combustion engine may preferably be encompassed as a source of driving force in a motor vehicle, preferably a utility vehicle (for example a truck or bus). The variable valve train 10 serves to permit a switching of one or more outlet valves of the internal combustion engine into an engine braking mode.

The variable valve train 10 has a camshaft 12, a first rocking lever 14 and a second rocking lever 16. The rocking levers 14 and 16 are pivotable about a rocking lever axis 18. The variable valve train 10 additionally has a valve bridge 20 and two (cylinder) outlet valves of the same cylinder of the internal combustion engine. The outlet valves 22 may be actuated (opened and closed) by means of the valve bridge 20 selectively by the first rocking lever 14 or the second rocking lever 16. If both outlet valves 22 are actuatable in each case by both rocking levers 14, 16, a guidance of the valve bridge 20 may be dispensed with. The outlet valves 22 are preferably designed as poppet valves which are arranged, for example, in a cylinder head of the internal combustion engine.

The first rocking lever 14 is connected via a first setting screw 24 to the valve bridge 20 for actuating the outlet valves 22. A valve clearance may be adjusted and re-adjusted via the setting screw 24.

The second rocking lever 16 is rigidly connected to the first rocking lever 14 via a setting screw 26. In detail, the setting screw 26 sits on a projection (a tab) 28 of the first rocking lever 14. The projection 28 may extend from a main body region of the first rocking lever 14 in a direction parallel to the rocking lever axis 18. A play which may arise, for example, due to production or assembly tolerances between the first rocking lever 14 and the second rocking lever 16 may be adjusted by the setting screw 26.

It is also possible that the rocking levers 14, 16 are rigidly connected together as a common body or that the rocking levers 14, 16 are pivotable relative to one another.

It is also possible that a valve bridge is not provided and, for example, only one outlet valve may be actuated directly by the rocking levers 14, 16. Alternatively, for example, it is also possible that the first rocking lever 14 actuates both outlet valves 22 by means of the valve bridge 20 and the second rocking lever 16 actuates only one of the two outlet valves 22, for example by means of a through-hole in the valve bridge 20.

Figure 2:
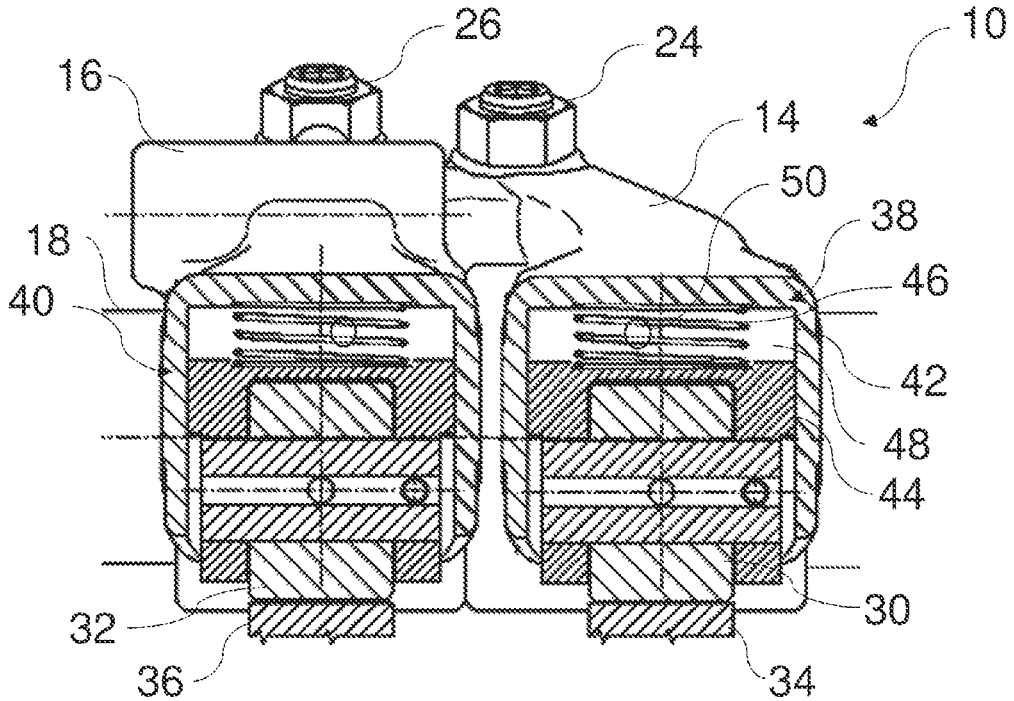
FIG. 2 shows a sectional view through the exemplary variable valve train.

It is shown in FIG. 2 that the first rocking lever 14 has a cam follower 30 and the second rocking lever 16 has a cam follower 32. The cam follower 30 follows a cam contour of a first cam 34 of the camshaft 12. The cam follower 32 follows a cam contour of a second cam 36 of the camshaft 12. The cam followers 30, 32 may be designed as rotatable rollers, as shown.

The cam followers 30, 32 are connected in each case by means of a stroke device (lost motion device) 38, 40 of the rocking levers 14, 16. Preferably, the stroke devices 38, 40 may be designed to have the same construction, as shown. The stroke devices 38 40 permit the cam contour of the first cam 34 or the second cam 36 to be selectively used by means of the rocking levers 14, 16 for actuating the outlet valves 22.

In a blocked or activated position, by means of the first rocking lever 14 the first stroke device 38 makes an operative connection between the first cam 34 and the outlet valves 22 (by the interposition of the valve bridge 20). In a non-blocked or deactivated position, the first stroke device 38 breaks this operative connection. Instead, the cam contour of the first cam 34 only leads to an upward and downward movement of the cam follower 30 without a movement of the first rocking lever 14.

In a comparable manner, by means of the second rocking lever 16 in a blocked or activated position the second stroke device 40 makes an operative connection between the second cam 36 and the outlet valves 22 (by the interposition of the first rocking lever 14 and the valve bridge 20). In a non-blocked or deactivated position, the second stroke device 40 breaks this operative connection. Instead, the cam contour of the second cam 36 only leads to an upward and downward movement of the cam follower 32 without a movement of the second rocking lever 16.

With the application of fluid or a supply of fluid, therefore, the first stroke device 38 and the second stroke device 40 make the respectively assigned operative connection. However, it is also possible that the first stroke device and the second stroke device are designed in each case to make the respectively assigned operative connection without the application of fluid and to break this operative connection with the application of fluid.

The stroke devices 38, 40 are activated such that at most one of the two stroke devices 38, 40 is in the respectively blocked or activated position. This is achieved by a fluid either being supplied only to the first stroke device 38 or only to the second stroke device 40. In other words, fluid is applied either only to the first stroke device 38 or only to the second stroke device 40.

Expediently, the stroke devices 38, 40 have the same construction. Hereinafter, therefore, only the construction of the stroke device 38 shown by way of example of FIG. 2 is described.

The stroke device 38 has a receiving chamber 42, a piston 44 and a resilient element 46.

The piston 44 is movably received in the receiving chamber 42. The resilient element 46 resiliently supports the piston 44 on a bottom surface of the receiving chamber 42. The resilient element 46 is expediently a spring, preferably a helical spring. The piston 44 bears the cam follower 30 in a rotatable manner. A fluid chamber 48 is formed between the bottom surface of the receiving chamber 42 and the piston 44. A fluid, preferably a hydraulic fluid, may be conducted via a fluid line 50 into and out of the fluid chamber 48. If a fluid is conducted into the fluid chamber 48 and a backflow of the fluid is blocked, the piston 44 is rigidly supported against the receiving chamber 42 via the fluid in the fluid chamber 48. The cam contour of the first cam 34 is transferred in a rigid manner via the stroke device 38 to the first rocking lever 14. If no fluid is conducted into the fluid chamber 48 or a backflow of the fluid is not blocked, the piston 44 is movable in the receiving chamber 42. The cam contour of the first cam 34 is compensated via the stroke device 38 and not transferred to the first rocking lever 14.

Figure 3:
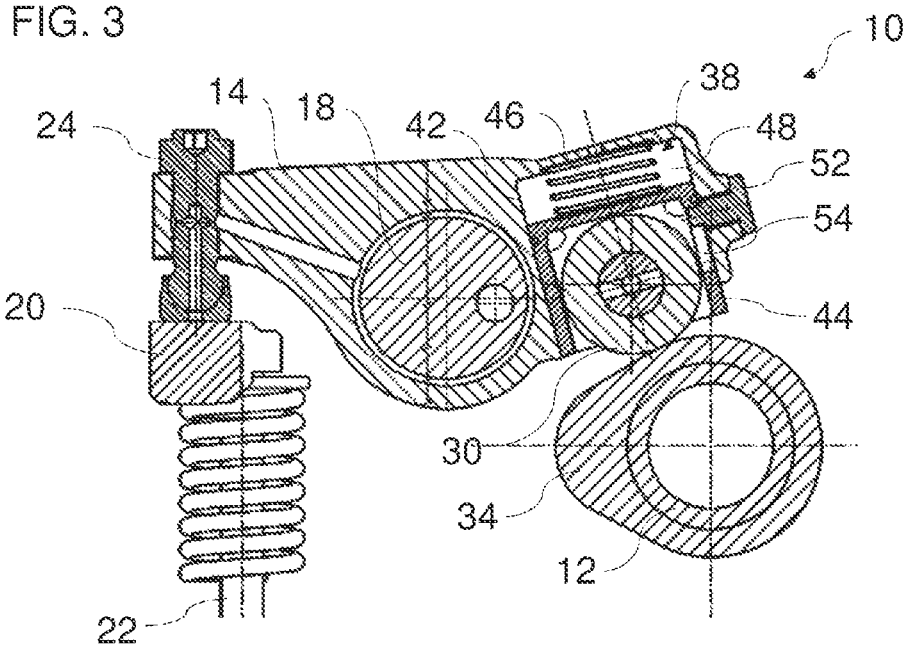
FIG. 3 shows a further sectional view through a rocking lever of the exemplary variable valve train.

FIG. 3 also shows that the piston 44 is secured from dropping out of the receiving chamber 42 by a safety mechanism 52. The safety mechanism 52 may engage, for example, in a longitudinal groove or a slot 54 of the piston 44 and thus additionally represent an anti-rotation device for the piston 44.

In the exemplary embodiment shown, the stroke devices 38, 40 are arranged on the camshaft side or the cam side relative to the rocking levers 14, 16. Alternative arrangements are also possible, for example a valve-side arrangement of stroke devices relative to the rocking levers. Additionally, the construction shown of the stroke devices 38, 40 is preferred but not limiting for the present disclosure. Different or modified configurations are also conceivable, if the assigned functionality (i.e. partial making or breaking of the respective operative connection) is able to be fulfilled.

In a normal operating mode of the internal combustion engine, the outlet valves 22 may be operated by means of the first cam 34. The outlet valves 22 may be opened in the region of the bottom dead center point at the start of the exhaust stroke and closed in the region of the top dead center point at the end of the exhaust stroke. In the remaining strokes the outlet valves 22 are closed. The first cam 34 is thus designed as a normal exhaust cam.

By means of the second cam 36 outlet valves 22 (or for example only one thereof) may be operated in an engine braking mode of the internal combustion engine. The second cam 36 is thus designed as an engine braking cam.

Figure 4:
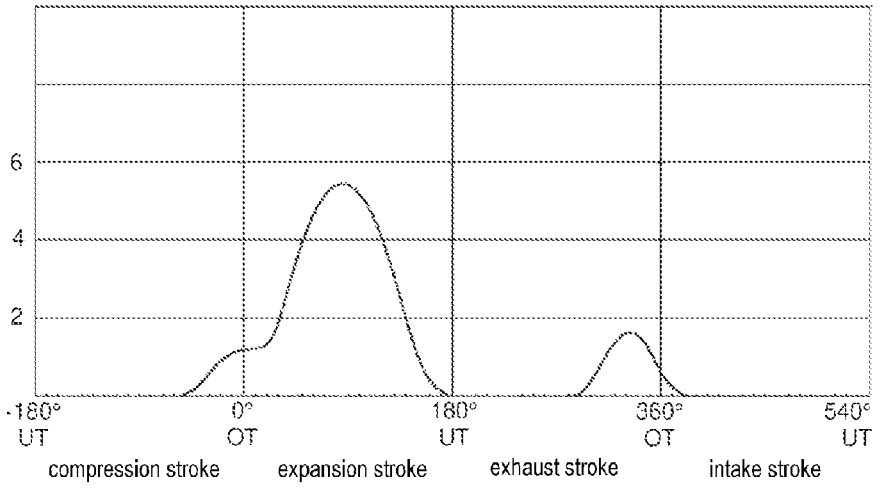
FIG. 4 shows an exemplary valve control curve.

FIG. 4 shows a particularly preferred non-limiting valve control curve for the outlet valves 22 in engine braking mode which may be effected by the second cam 36.

In FIG. 4 the abscissa (x-axis) refers to a crankshaft angle and the ordinate (y-axis) to a valve stroke in mm. A full four-stroke cycle consisting of compression, expansion, exhaust and intake is shown.

The valve control curve for the engine braking mode shows that the outlet valve is slightly opened at the end of the compression stroke in the region of the top dead center point at 60° KW to 100° KW before the top dead center point. At the top dead center point the outlet valve is opened further and closes at the end of the expansion stroke, approximately at the bottom dead center point. The opening of the outlet valve at the end of the compression stroke causes the compressed air in the cylinder to be pushed through the open outlet valve into the exhaust gas system by the piston moving to the top dead center point. The previously performed compression work brakes the crankshaft and thus the internal combustion engine. The cylinder pressure initially rises in the compression stroke, but then drops before the top dead center point as a result of the outlet valve being already opened. The open outlet valve during the expansion stroke causes air from the exhaust gas lines to be suctioned back into the cylinder. At the end of the expansion stroke, the cylinder is substantially filled with air from the exhaust gas system.

The valve control curve additionally shows that after reaching the bottom dead center point at the end of the expansion stroke the outlet valve initially remains closed. At the end of the exhaust stroke, the outlet valve opens in the region of the top dead center point. The opening takes place again at approximately 60° KW to 100° KW before the top dead center point. The closed outlet valve during the first portion of the exhaust stroke causes the air suctioned-in in the expansion stroke to be compressed whilst performing work. The cylinder pressure rises. The compression work brakes the crankshaft and thus the internal combustion engine. The opening of the outlet valve at the end of the exhaust stroke leads to the air being pushed into the exhaust gas system through the open outlet valve. In the intake stroke, the cylinder is filled again with air through the open inlet valve(s). The cycle begins again.

As described above, the use of the second cam 36 leads to a two-fold compression with subsequent decompression, so that an effective engine braking functionality is ensured.

Figure 5:
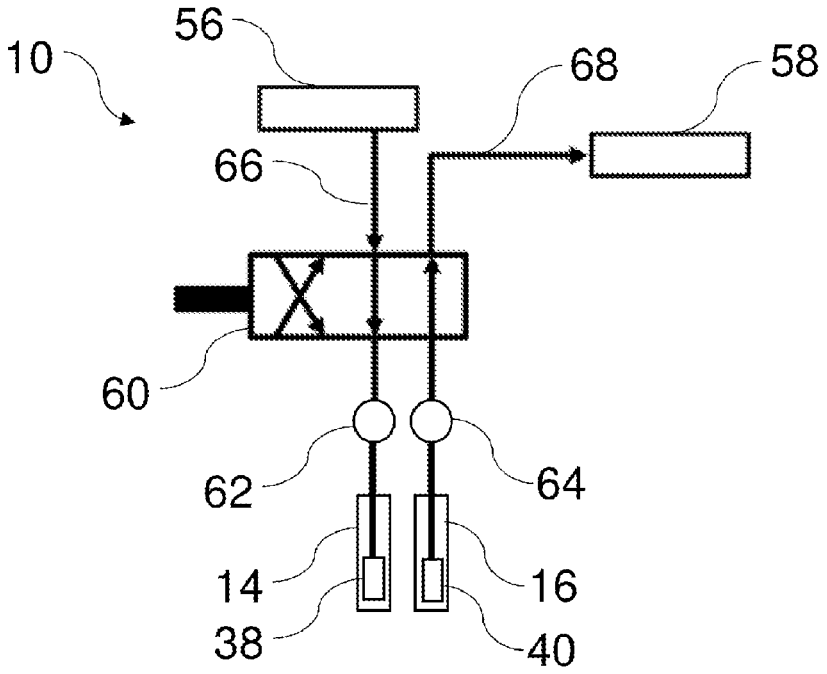
FIG. 5 shows a schematic view of the exemplary variable valve train.

FIG. 5 shows schematically how fluid is supplied to the stroke devices 38, 40 and discharged therefrom.

The variable valve train 10 has a (hydraulic) fluid system with a pressurized fluid source 56, a fluid reservoir 58, a valve device 60 and two backflow preventers 62, 64.

The pressurized fluid source 56 may supply pressurized fluid to the valve device 60 by means of a fluid feed line 66. For example, the pressurized fluid source 56 may be designed as a fluid pump or hydraulic pump. The pressurized fluid source 56 may be connected to the fluid reservoir 58. Via a fluid discharge line 68 (fluid drain line) fluid may be conducted from the valve device 60 to the fluid reservoir 58. The fluid reservoir 58 may be designed, for example, as an oil pan.

The valve device 60 may adopt (at least) two different positions. In the (first) position shown, the pressurized fluid source 56 is connected to the first stroke device 38. In the first position of the valve device 60 the second stroke device 40 is connected to the fluid reservoir 58. In a second position, the pressurized fluid source 56 is connected to the second stroke device 40. In the second position of the valve device 60 the first stroke device 38 is connected to the fluid reservoir 58. Thus it is possible in a particularly simple manner to switch to and fro between the rocking levers 14 and 16 and thus the cams 34 and 36. The valve device 60 may expediently be designed in this case as a 4/2-way valve (valve with four ports and two positions). An embodiment as a series or parallel connection of a plurality of valves is also possible.

In normal operation of the internal combustion engine, the valve device 60 is in the first position. In engine braking mode of the internal combustion engine, the valve device 60 is in the second position. In the first position, the first stroke device 38 is switched to be rigid and the second stroke device 40 is switched to be movable. The first rocking lever 14 is activated and the second rocking lever 16 is deactivated. In the second position, the first stroke device 38 is switched to be movable and the second stroke device 40 is switched to be rigid. The first rocking lever 14 is deactivated and the second rocking lever 16 is activated.

The backflow preventers 62, 64 may be designed as control or regulating valves. The backflow preventers 62, 64 are designed to prevent an undesired backflow from the respective stroke device 38, 40, as is described in detail for example with reference to FIGS. 7 to 9. Additionally, the backflow preventers 62, 64 may permit a backflow from the stroke devices 38, 40, when the valve device 60 connects the corresponding stroke device 38, 40 to the fluid drain line 68 or no pressurized fluid from the pressurized fluid source 56 is applied to the respective backflow preventer 62, 64.

Figure 6:
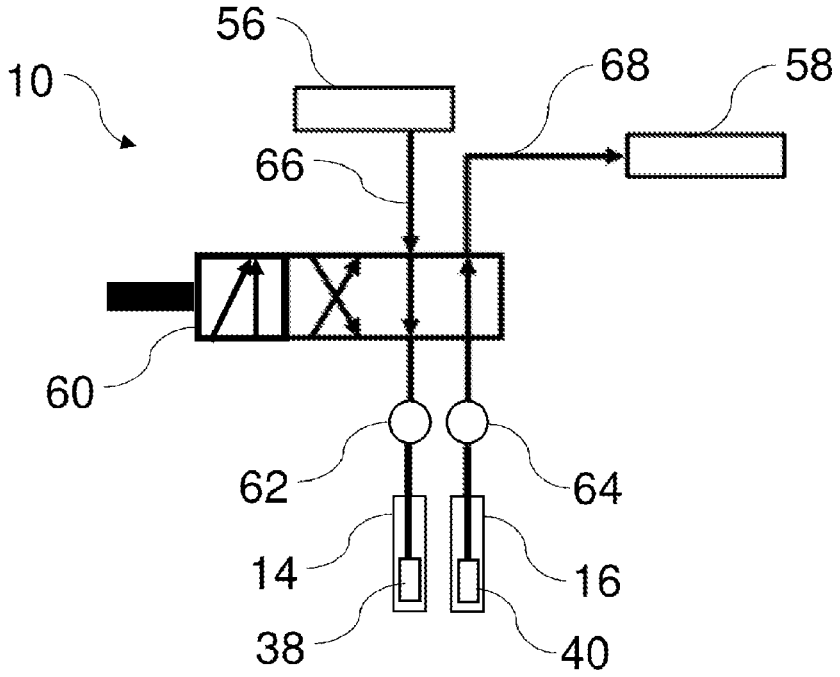
FIG. 6 shows a schematic view of a further exemplary variable valve train.

FIG. 6 shows a fluid system which is modified relative to FIG. 5.

The fluid system of FIG. 6 differs from the fluid system according to FIG. 5 in that the valve device 60 may adopt a third position. Expediently, the valve device 60 in this case may be designed as a 4/3-way valve (directional valve with 4 ports and 3 positions). A design as a series and/or parallel connection of a plurality of valves is also possible.

In the third position, both stroke devices 38, 40 are connected to the fluid reservoir 58. Thus none of the stroke devices 38, 40 is activated. None of the assigned rocking levers 14, 16 is pivoted during a camshaft revolution. The outlet valves 22 remain closed. Thus a cylinder deactivation may be implemented in a simple manner relative to the outlet valves 22. Additionally, the inlet valves may also be kept closed and the fuel supply stopped in order to deactivate the corresponding cylinder.

Figure 7:
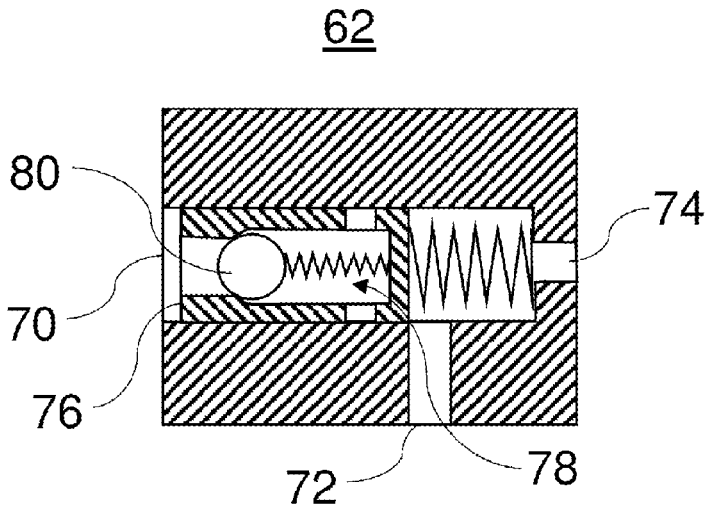
FIG. 7 shows a schematic view of a backflow preventer of the exemplary variable valve train.
Figure 8:
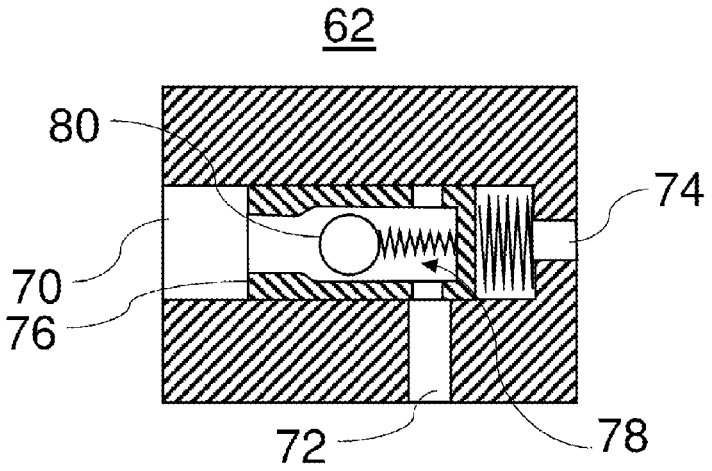
FIG. 8 shows a schematic view of the backflow preventer in a further position.
Figure 9:
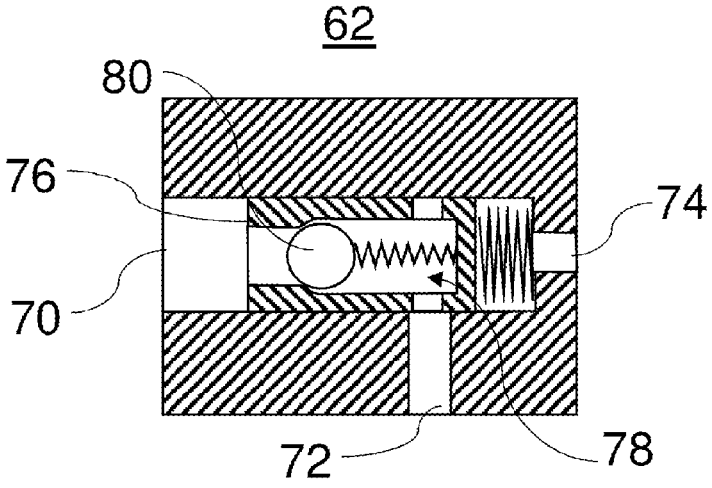
FIG. 9 shows a schematic view of the backflow preventer in a further different position.

FIGS. 7 to 9 show an exemplary embodiment of the backflow preventer 62. The backflow preventer 64 may be designed to have the same construction or at least the same function as the backflow preventer 62.

The backflow preventer 62 has a pressurized fluid supply 70, a fluid line 72 and a fluid drain 74. The pressurized fluid supply 70 serves for the supply of pressurized fluid from the valve device 60 to the backflow preventer 62. The fluid line 72 serves for the supply of pressurized fluid from the backflow preventer 62 to the stroke device 38 and for the discharge of fluid from the stroke device 38 to the backflow preventer 62. The fluid discharge 74 serves for the drainage of fluid from the backflow preventer 62 to the valve device 60 and/or the fluid drain line 68.

The backflow preventer 62 has a movable piston 76. In a resting position (FIG. 7) the piston 76 blocks the pressurized fluid supply 70 and produces a fluidic connection between the fluid line 72 and the fluid drain 74 for the drainage of fluid from the stroke device 38. The piston 76 is resiliently pretensioned in the direction of the resting position, preferably spring-pretensioned.

The backflow preventer 62 has a check valve 78 with a movable locking element 80, for example a ball. The locking element 80 is resiliently pretensioned in the direction of a closed position, preferably spring-pretensioned. The check valve 78 is received in the piston 76.

FIG. 8 shows that when pressurized fluid is supplied via the pressurized fluid supply 70 to the backflow preventer 62, the piston 76 may be initially moved such that the fluid drain 74 is blocked. Additionally, the locking element 80 may be moved counter to the resilient pretensioning, lifted away from the valve seat and produce a fluidic connection between the pressurized fluid supply 70 and the fluid line 72. Pressurized fluid may be supplied to the stroke device 38 in order to activate the stroke device 38.

If a valve stroke is effected by the first cam 34 when the stroke device 38 is activated (see FIG. 2), the pressure in the fluid line 72 rises abruptly. The check valve 78 closes by moving the locking element 80 into the valve seat, see FIG. 9. The fluid may not escape from the stroke device 38. The rocking lever 14 is pivoted. Thus the backflow preventer 62 additionally acts as a hydraulic valve clearance compensating device, in particular in combination with the stroke device 38 which is blocked only hydraulically in the activated position, i.e. in particular without a mechanical blocking device (for example no locking piston) being provided.

The present disclosure is not limited to the above-described preferred exemplary embodiments. Instead, a plurality of variants and modifications, which also make use of the inventive idea and thus fall within the scope of protection, are possible. In particular, the present disclosure also claims protection for the subject and the features of the subclaims independently of the claims referred to. In particular, the individual features of the independent claim 1 are disclosed in each case independently of one another. Additionally, the features of the subclaims are also disclosed independently of all of the features of the independent claim 1 and, for example, independently of the features relative to the presence and/or configuration of the camshaft, the first rocking lever, the second rocking lever, the fluid feed line and/or the valve device of the independent claim 1. All range specifications herein are to be understood as disclosed such that all values falling within the respective range are disclosed individually, for example also as the respectively preferred narrower outer boundaries of the respective range.

LIST OF REFERENCE NUMERALS

10 Variable valve train
12 Camshaft
14 First rocking lever
16 Second rocking lever
18 Rocking lever axis
20 Valve bridge
22 Outlet valve
24 Setting screw
26 Setting screw
28 Projection
30 Cam follower
32 Cam follower
34 First cam
36 Second cam
38 First stroke device
40 Second stroke device
42 Receiving chamber
44 Piston
46 Resilient element
48 Fluid chamber
50 Fluid line
52 Safety mechanism
54 Slot
56 Pressurized fluid source
58 Fluid reservoir
60 Valve device
62 First backflow preventer
64 Second backflow preventer
66 Fluid feed line
68 Fluid drain line
70 Pressurized fluid supply
72 Fluid line
74 Fluid drain
76 Piston
78 Check valve
80 Locking element

The invention claimed is:

1. A variable valve train for switching an outlet valve of an internal combustion engine to an engine braking mode, the variable valve train comprising:

a camshaft including:

a first cam configured as a normal operation cam, and a second cam configured as an engine braking cam;

a first rocking lever including a first stroke device configured to selectively activate and deactivate a first operative connection between the first cam and the outlet valve via the first rocking lever;

a second rocking lever including a second stroke device configured to selectively activate and deactivate a second operative connection between the second cam and the outlet valve via the second rocking lever;

and a valve device configured to alternately connect the first stroke device and the second stroke device to a fluid feed line.

2. The variable valve train as claimed in claim 1, wherein the valve device is further configured to selectively connect at least one of the first stroke device or the second stroke device to a fluid drain line.

3. The variable valve train as claimed in claim 2, wherein the valve device is further configured to switch between:

a first position in which the first stroke device is connected to the fluid feed line and the second stroke device is connected to the fluid drain line; and a second position in which the first stroke device is connected to the fluid drain line and the second stroke device is connected to the fluid feed line.

4. The variable valve train as claimed in claim 1, further comprising:

a first backflow preventer arranged between the valve device and the first stroke device; or a second backflow preventer arranged between the valve device and the second stroke device.

5. The variable valve train as claimed in claim 4, wherein:

the first backflow preventer acts as a hydraulic valve clearance compensating device for the first operative connection; or the second backflow preventer acts as a hydraulic valve clearance compensating device for the second operative connection.

6. The variable valve train as claimed in claim 4, wherein:

the first backflow preventer acts as a hydraulic valve clearance compensating device of the first operative connection, when the first backflow preventer blocks a backflow from the first stroke device; or the second backflow preventer acts as a hydraulic valve clearance compensating device of the second operative connection, when the second backflow preventer blocks a backflow from the second stroke device.

7. The variable valve train as claimed in claim 4, wherein:

the first backflow preventer is configured to switch between:

a first position in which a backflow of fluid from the first stroke device to the valve device or a fluid drain line is enabled;

a second position in which a supply of fluid from the valve device to the first stroke device is enabled; and a third position to block a backflow of fluid from the first stroke device to the valve device is blocked; or the second backflow preventer configured to switch between:

a first position in which a backflow of fluid from the second stroke device to the valve device or a fluid drain line is enabled;

a second position in which a supply of fluid from the valve device to the second stroke device is enabled; and a third position in which a backflow of fluid from the second stroke device to the valve device is blocked.

8. The variable valve train as claimed in claim 7, wherein:

the first backflow preventer is automatically switched to the first position, the second position and third position based on a fluid supply pressure and a fluid counterpressure on the first backflow preventer; or the second backflow preventer is automatically switched to the first position, the second position and third position based on a fluid supply pressure and a fluid counterpressure on the second backflow preventer.

9. The variable valve train as claimed in claim 1, wherein:

the first operative connection is activated when hydraulic pressure is applied to the first stroke device, and the second operative connection is activated when hydraulic pressure is applied to the second stroke device; or the first operative connection is deactivated when hydraulic pressure is applied to the first stroke device, and the second operative connection is deactivated when hydraulic pressure is applied to the second stroke device.

10. The variable valve train as claimed in claim 1, wherein:

the first stroke device and the second stroke device have a same construction or a same function.

11. The variable valve train as claimed in claim 1, wherein:

the first stroke device or the second stroke device is selectively blocked hydraulically without a mechanical blocking device.

12. The variable valve train as claimed in claim 1, wherein:

the first stroke device or the second stroke device includes:

a receiving chamber;

a piston displaceably arranged in the receiving chamber;

a cam follower connected to the piston for displacement;

a fluid chamber defined by the piston; and a resilient element configured to pretension the piston.

13. The variable valve train as claimed in claim 1, wherein: the valve device is a directional valve.

14. The variable valve train as claimed in claim 1, wherein the valve device is a 4-2-way directional valve or a 4-3-way directional valve.

15. The variable valve train as claimed in claim 1, wherein:

in a third position the valve device keeps the outlet valve closed.

16. The variable valve train as claimed in claim 15, wherein in the third position the valve device is configured to connect the first stroke device and the second stroke device to a fluid drain line so as to keep the outlet valve closed.

17. The variable valve train as claimed in claim 1, wherein the outlet valve includes a first outlet valve and a second outlet valve such that:

the first operative connection acts on the first and second outlet valves, and the second operative connection acts on the first and second outlet valves; or the first operative connection acts on the first and second outlet valves and the second operative connection acts only on the first outlet valve.

18. The variable valve train as claimed in claim 1, wherein:

the second cam is configured to keep the outlet valve initially closed in a compression stroke or in an exhaust stroke, and to open said outlet valve before reaching a top dead center position of a piston movement; or the first cam is configured to open the outlet valve in the exhaust stroke and to keep the outlet valve closed in an intake stroke, in the compression stroke, and in the expansion stroke.

19. The variable valve train as claimed in claim 1, wherein:

the second cam is configured to keep the outlet valve initially closed in a compression stroke and/or in an exhaust stroke, and to open said outlet valve between 60° and 100° of crank angle before reaching a top dead center position of a piston movement.

20. A motor vehicle comprising the variable valve train as claimed in claim 1.

21. The motor vehicle of claim 20, wherein the motor vehicle is a utility vehicle.

* * * * *